United States Patent [19]

Hills

[11] 4,126,306

[45] Nov. 21, 1978

[54] FEEDING APPARATUS

[75] Inventor: Eric G. Hills, London, England

[73] Assignee: The Post Office, London, England

[21] Appl. No.: 852,682

[22] Filed: Nov. 18, 1977

Related U.S. Application Data

[63] Continuation of Ser. No. 721,584, Sep. 8, 1976, abandoned.

[30] Foreign Application Priority Data

Sep. 12, 1975 [GB] United Kingdom ..... 37612/75

[51] Int. Cl.[2] ..... B65H 3/12; B65H 3/52

[52] U.S. Cl. ..... 271/94; 198/459; 271/34; 271/104; 271/125; 271/274

[58] Field of Search ..... 271/34, 35, 94, 104, 271/124, 125, 121, 122, 274, 273, 251, 12, 11, 137, 138, 182; 198/459, 633, 534

[56] References Cited

U.S. PATENT DOCUMENTS

| | | | |
|---|---|---|---|
| 2,950,675 | 8/1960 | Copping et al. | 271/122 X |
| 3,210,074 | 10/1965 | Miaskoff | 271/274 X |
| 3,511,368 | 5/1970 | Kajitani et al. | 271/34 X |
| 3,762,700 | 10/1973 | Peterson et al. | 271/273 X |

*Primary Examiner*—Bruce H. Stoner, Jr.
*Attorney, Agent, or Firm*—Kemon & Estabrook

[57] ABSTRACT

Apparatus for feeding flat items comprising a rotatable body, a drive member having a drive surface for drivingly contacting the surface of an item, said body and said member defining therebetween a nip, and respective surface portions of the body and the member at the nip being movable only in directions extending askew of one another with a skew angle such that the body surface portion frictionally resists the passage of an item through the nip.

7 Claims, 2 Drawing Figures

FEEDING APPARATUS

Figure 1:
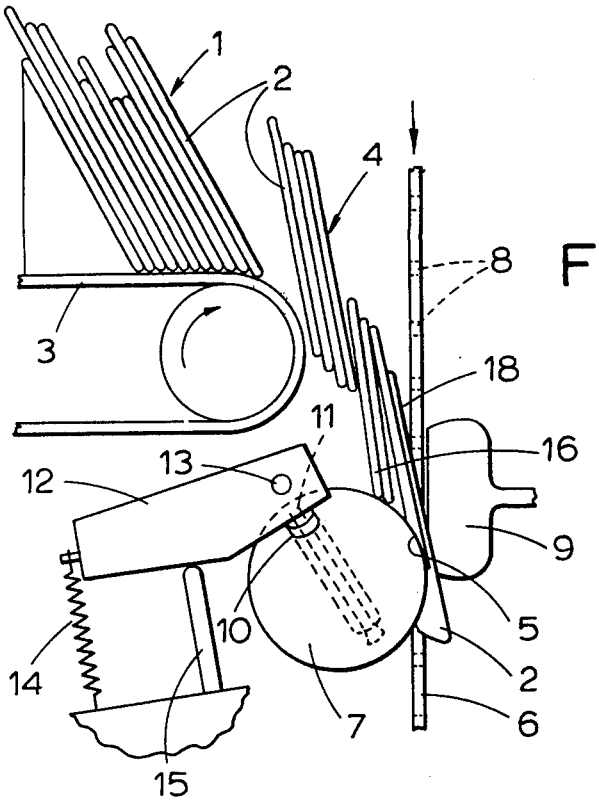

This is a continuation, of application Ser. No. 721,584, filed 9/8/76, now abandoned.

This invention relates to apparatus for handling substantially flat items, for example, documents, letters, postcards, cheques and punched cards. The invention is concerned particularly with apparatus for handling flat postal items, i.e. letters and postcards.

In the handling of flat items, there are occasions when single items must be separated and conveyed from a stack of such items. Various forms of separating apparatus have been proposed for effecting such separation and their efficiency varies according to the nature and variability of the flat items. Two basic types of separating apparatus are known, the friction feed type and the vacuum feed type. In both types, it is difficult to ensure that only one item at a time is fed forward. Where the flat items are postal items, the simultaneous feeding of two or more items may be a serious consequence. The postal items may be incorrectly sorted and their delivery time much extended by mis-routing, or postage revenue may be lost through failure to cancel postage stamps. Various methods have been suggested for avoiding the simultaneous feeding of two or more items but such methods have not been completely successful.

It is an object of the present invention, to provide apparatus for reducing the possibility of feeding simultaneously from a stack of items two or more of such items.

According to the invention there is provided apparatus for feeding flat items comprising:

a rotatable body, a drive member having a drive surface for drivingly contacting the surface of an item, said body and said member defining therebetween a nip, and respective surface portions of the body and the member at the nip being movable only in directions extending askew of one another with a skew angle such that the body surface portion frictionally resists the passage of an item through the nip.

The nip is preferably a resilient nip. The apparatus can include spring means biassing said body into a position such that said surface portion thereof is a predetermined spacing from the surface portion of the drive surface.

When an item is driven through the nip by said drive surface, a component of its motion is transmitted to the body which consequently rotates through an angle dependent on the skew angle. Such rotation inhibits the formation of a flat area on the body by wear caused by passage of items through the nip.

If two overlapping items enter the nip, the item nearer the drive surface is thereby driven through the nip while movement of the item further from the drive surface is frictionally resisted by said body surface whereby the overlapped items are separated.

The body surface and the drive surface preferably have co-operating shapes such that a stack of flat items falling edgewise into the nip locate so that one of said items is in the nip and the other items have their edges abutting said body surface. The body can for example present a convex surface to a flat surface of said drive member.

Said body can take the form of a pair of rotatably mounted rollers or spheres located so as to provide a double nip, the rollers or spheres having their rotational axes inclined symmetrically to the direction of movement of the drive surface portion. In the case of a pair of spheres, their rotational axes can also be inclined with respect to the tangential plane to said drive surface portion. In the latter arrangement said spheres can be so mounted as to be readily inverted on their rotational axes to further distribute wear caused by passage of items.

The spheres and drive member can be dimensioned and arranged so that items passing through the double nip are bowed about their longitudinal axes. Such bowing in the case of a very thin item provides a structure more resistant to bending about transverse axes.

According to another aspect of the invention there is provided apparatus suitable for feeding items seriatim from a stack comprising a path along which items are constrained to move in a first direction, braking means mounted in said path and having a surface which engages a surface of the items and is rotatably mounted about an axis extending askew of said direction thereby to provide a frictional force on said surface of each item in a direction opposite to said first direction, said frictional force being greater than the static frictional force between contacting surfaces of adjacent items so as to produce separation thereof.

Figure 2:
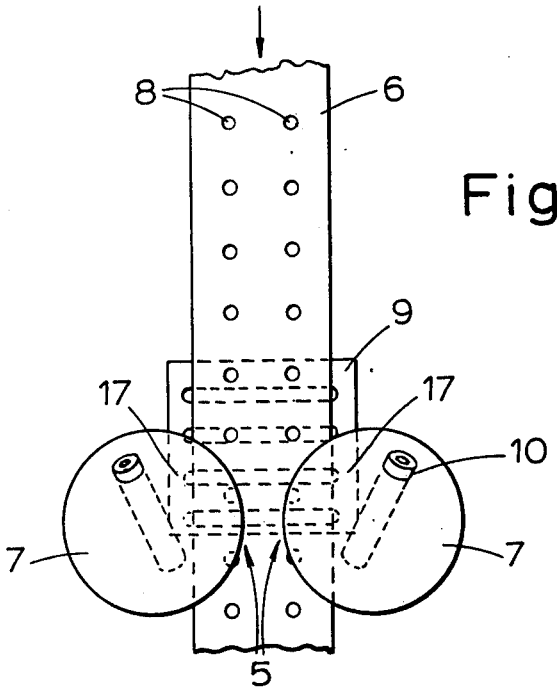

An embodiment of the invention will now be described by way of example with reference to the accompanying schematic drawings in which:

FIG. 1 is a side elevation of feeding apparatus having a double nip provided by a pair of spherical bodies co-operating with a drive belt; and FIG. 2 is a view of part of the apparatus of FIG. 1.

Referring to the drawings in detail, FIG. 1 shows a stack 1 of vertically arranged letters 2 being driven by a conveyor belt 3. As the letters 2 reach the end of the conveyor, they fall either singly or, if adhering together by, for example, static friction, as a thin stack 4 into nips 5 formed between a letter drive belt 6 and the surfaces of a pair of rotatably mounted spherical bodies 7 as shown in FIG. 2. The belt 6 and the spherical bodies 7 can either engage one another or be closely spaced depending on the thickness of items to be fed by the apparatus.

The drive belt 6 has apertures 8 throughout its length and passes over a suction head 9. On establishment of suction at the head 9, this is transmitted through the apertures 8 so that any immediately adjacent letter 2 falling into the nips 5 is sucked against the belt 6 and is thereby driven downwardly through the nips 5.

Each of the spherical bodies is made of high density polypropylene and is moulded onto a sleeve bearing 10 in which a journal 11 is received. The journals 11 form part of a frame 12 pivoted about an axis 13 the frame 12 being biased by a tension spring 14 to the position shown in FIG. 1 in which the frame 12 abuts a stop 15.

In this position, the spherical bodies 7 are located so that the apertured belt 6 intrudes into the space between the spherical bodies. In this way bowing of letters 2 entering the nips 5 is ensured. The bowed letters, though they may be very thin, provide comparatively rigid structures which are more resistant to bending than un-bowed letters.

As can be seen from FIG. 2, the axes of rotation of the spherical bodies 7 extend skew-wise relative to the direction of movement of the drive belt 6. The angle of skew in each case is 15°, the spherical bodies 7 being symmetrically mounted either both "toed in" or both "toed out".

Referring back to FIG. 1, the axes of rotation of the spherical bodies are also inclined to the plane of the drive belt 6 at an angle of 35°. By virtue of the skew mounting of the axes of the spherical bodies 7 relative to the drive belt 6, respective surface portions (not shown) of the bodies 7 and the belt 6 at the nips 5 will be free to move only in directions askew of one another. The reason for the inclination of the rotational axes to the plane of the drive belt 6 will be explained presently.

If a single letter falls into the nip 5, it is sucked against the drive belt 6 and passes with the belt down through the nips 5. The movement of each letter 2 is frictionally resisted by the spherical bodies 7 by virtue of their skew mounting and consequently a component of the letter's movement perpendicular to the axes of rotation of the bodies 7 produces rotation of each body 7. Thus, following the passage of each letter 2, a new surface portion of the spherical bodies 7 is presented to the respective nips 5. This periodic renewal of nip surface inhibits the development of a flat area which would have a detrimental effect on the seriatim feeding facility of the apparatus.

When a stack of two or more letters 2 falls into the nips 5, then usually only the letter 2 nearest the drive belt 6 is driven through the nip, the other letters being prevented from passing through the nips 5 by their leading edges 16 contacting an upper surface 17 of each of the spherical bodies 7. In this event, as soon as a leading letter 2 has been driven sufficiently far into the nips 5 for its trailing edge 18 to clear the suction head 9, the suction acts on the adjacent letter which is subsequently driven into the nips 5. With the relative positions of suction head 9 and the nips 5 shown in FIG. 1, letters 2 issue in a tiled stream since before a first letter has been completely ejected from the nips 5 a second letter will be fed into the nips under the influence of the suction head 9.

Should two relatively thin letters adhering together, for example, by static friction enter the nips 5, the letter furthest from the drive belt 6 is subjected to a frictional resistance having a magnitude dependent on the angle of skew between the respective permitted directions of movement of the surface portions at the nips 5. This frictional resistance inhibits this letter from passing further into the nips, while the letter nearest the drive belt 6 experiences no such resistance and is driven downwardly through the nips 5 thereby separating the doubled letters. Subsequently, the trailing edge 18 of the first letter 2 clears the suction head 9 which then acts directly against the second letter 2 to force it into engagement with the drive belt 6 which conveys it through the nips 5. The main reason for the 35° inclination of the rotational axes of the spherical bodies to the plane of the drive belt 6 is to prevent thick letters from wedging in the nip on entry from above as shown in FIG. 1. Additionally, on passage of letters 2 through the nips 5 and on corresponding rotation of the spherical bodies 7, the parts of the spherical body surfaces subjected to wear do not lie along great circles. In this way, when the passage of letters has detrimentally worn a surface part of the bodies 7, they can be inverted on their rotational axes to present a fresh surface portion to the nips 5.

With both spherical bodies 7 "toeing in" as shown in FIG. 2, then as letters 2 pass through the nips 5, they will be subjected to a slight lateral tension which ensures that they pass through the nips without lateral buckling. If fairly rigid items are to be fed through the nips 5, then the spherical bodies 7 can "toe out".

In an alternative embodiment (not shown), a single skew mounted spherical body or roller can be utilised to provide a single nip, though for letter feeding such an embodiment should include a guide surface alongside the nip to engage an edge of each letter to prevent the single spherical body or roller from rotating the letters.

What is claimed is:

1. Feeding apparatus for feeding flat items comprising:

a drive member for driving an item in a feed direction;

a friction member for resisting feeding of the flat item;

the drive member and the friction member being so mounted as to provide a nip and to act on opposite sides of the item with a reaction force between the drive member and the item greater than a reaction force between the friction member and the item; and said friction member is in the form of a first rotatably mounted sphere whose rotational axis extends askew of the feeding direction, whereby the friction member frictionally resists passage of the item and whose rotational axis is additionally inclined with respect to the tangential plane of the drive member at said nip.

2. Apparatus as claimed in claim 1 wherein said sphere is resiliently mounted to provide a yieldable nip.

3. Apparatus as claimed in claim 2 further comprising spring means biasing said sphere into a position such that a contact surface portion thereof is a predetermined spacing from a contact surface portion of the drive member.

4. Apparatus as claimed in claim 1 and further comprising a second rotatably mounted sphere similar to the first sphere, said spheres being mounted relative to the drive member to provide a pair of nips, the spheres having their rotational axes extending generally symmetrically askew of said feed direction.

5. Apparatus as claimed in claim 4 wherein the spheres have a sleeves bearing at both ends of their rotational axes whereby the spheres are readily invertible on their axes thereby to distribute wear caused by passage of items through the nips.

6. Apparatus as claimed in claim 4 wherein the drive member is a belt and suction means located adjacent the belt acts through the belt to suck an item against the belt and thereby to provide said reaction force between the drive member and the item.

7. Apparatus as claimed in claim 6 wherein the spheres are respectively located at the extreme edges of the belt and are so dimensioned that flat items passing through the double nip are bowed about their longitudinal axes.

* * * * *